US007401826B1

(12) United States Patent
Marrett

(10) Patent No.: US 7,401,826 B1
(45) Date of Patent: Jul. 22, 2008

(54) PUWI-BAG

(76) Inventor: Karl Marrett, 787 Adee Ave., Bronx, NY (US) 10467

( * ) Notice: Subject to any disclaimer, the term of this patent is extended or adjusted under 35 U.S.C. 154(b) by 623 days.

(21) Appl. No.: 11/139,365

(22) Filed: May 26, 2005

Related U.S. Application Data

(60) Provisional application No. 60/614,806, filed on Oct. 1, 2004.

(51) Int. Cl.
*A01K 29/00* (2006.01)
*B65D 33/06* (2006.01)

(52) U.S. Cl. ..... 294/1.4

(58) Field of Classification Search ..... 294/1.3, 294/1.4, 1.5; 248/95, 99, 100, 101; 15/257.1, 15/257.6, 257.7, 257.9; D34/5, 6
See application file for complete search history.

(56) References Cited

U.S. PATENT DOCUMENTS 3,830,423 A * 8/1974 Prescott ..... 294/1.3
3,872,834 A * 3/1975 Fuhrman ..... 294/1.4
3,879,079 A * 4/1975 Nicholas ..... 294/1.4
4,196,928 A 4/1980 Spangler
D285,012 S * 8/1986 Willis ..... 294/1.4
4,705,310 A * 11/1987 Scripter ..... 294/1.4
5,011,103 A * 4/1991 Hayes et al. ..... 248/99
5,413,394 A * 5/1995 Mitchell ..... 15/257.7
6,030,011 A 2/2000 Layton

FOREIGN PATENT DOCUMENTS

FR 2686106 * 7/1993 ..... 294/1.3

* cited by examiner

*Primary Examiner*—Saul J. Rodriguez
*Assistant Examiner*—Paul T Chin

(57) ABSTRACT

An apparatus that can pick up animal waste, be effectively sealed, and then be carried around like a bag until the animal waste can be properly disposed of in a safe and healthful manner. The apparatus is a bag fabricated from a water-resistant material, with the bag having a base, a rear plate, and a front plate near an opening. The apparatus has two detachable holding poles. A drawstring is attached to the front plate and allows an individual to scoop up animal waste, seal the opening, and then carry the apparatus in a manner similar to that of a tote bag until the animal waste can thrown away in a proper location.

4 Claims, 4 Drawing Sheets

PUWI-BAG

I. CROSS-REFERENCE TO RELATED APPLICATIONS

This application claims the benefit of U.S. Provisional Application No. 60/614,806 filed Oct. 1, 2004.

II. BACKGROUND OF THE INVENTION

The present invention concerns that of an apparatus that can pick up animal waste, be effectively sealed, and then be carried around like a bag until the animal waste can be properly disposed of in a safe and healthful manner.

III. DESCRIPTION OF THE PRIOR ART

U.S. Pat. No. 4,196,928, issued to Spangler, discloses a material pickup device comprised of a pair of handles with one with a rake and the other for holding a bag.

U.S. Pat. No. 6,030,011, issued to Layton, discloses a waste collection device with a set of handles, one with a receptacle suited to hold a liner and the other with a rake device.

U.S. Pat. No. D285,012, issued to Willis, discloses an ornamental design for a refuse collection device.

IV. SUMMARY OF THE INVENTION

The present invention concerns that of an apparatus that can pick up animal waste, be effectively sealed, and then be carried around like a bag until the animal waste can be properly disposed of in a safe and healthful manner. The apparatus is a bag fabricated from a water-resistant material, with the bag having a base, a rear plate, and a front plate near an opening. The apparatus has two detachable holding poles. A drawstring is attached to the front plate and allows an individual to scoop up animal waste, seal the opening, and then carry the apparatus in a manner similar to that of a tote bag until the animal waste can thrown away in a proper location.

There has thus been outlined, rather broadly, the more important features of an apparatus for collecting animal waste that the detailed description thereof that follows may be better understood and in order that the present contribution to the art may be better appreciated. There are, of course, additional features of the apparatus for collecting animal waste that will be described hereinafter and which will form the subject matter of the claims appended hereto.

In this respect, before explaining at least one embodiment of the apparatus for collecting animal waste in detail, it is to be understood that the apparatus for collecting animal waste is not limited in its application to the details of construction and to the arrangements of the components set forth in the following description or illustrated in the drawings. The apparatus for collecting animal waste is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present apparatus for collecting animal waste. It is important, therefore, that the claims be regarded as including such equivalent constructions insofar as they do not depart from the spirit and scope of the present invention.

It is therefore an object of the present invention to provide an apparatus for collecting animal waste which has all of the advantages of the prior art and none of the disadvantages.

It is another object of the present invention to provide an apparatus for collecting animal waste which may be easily and efficiently manufactured and marketed.

It is another object of the present invention to provide an apparatus for collecting animal waste which is of durable and reliable construction.

It is yet another object of the present invention to provide an apparatus for collecting animal waste which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
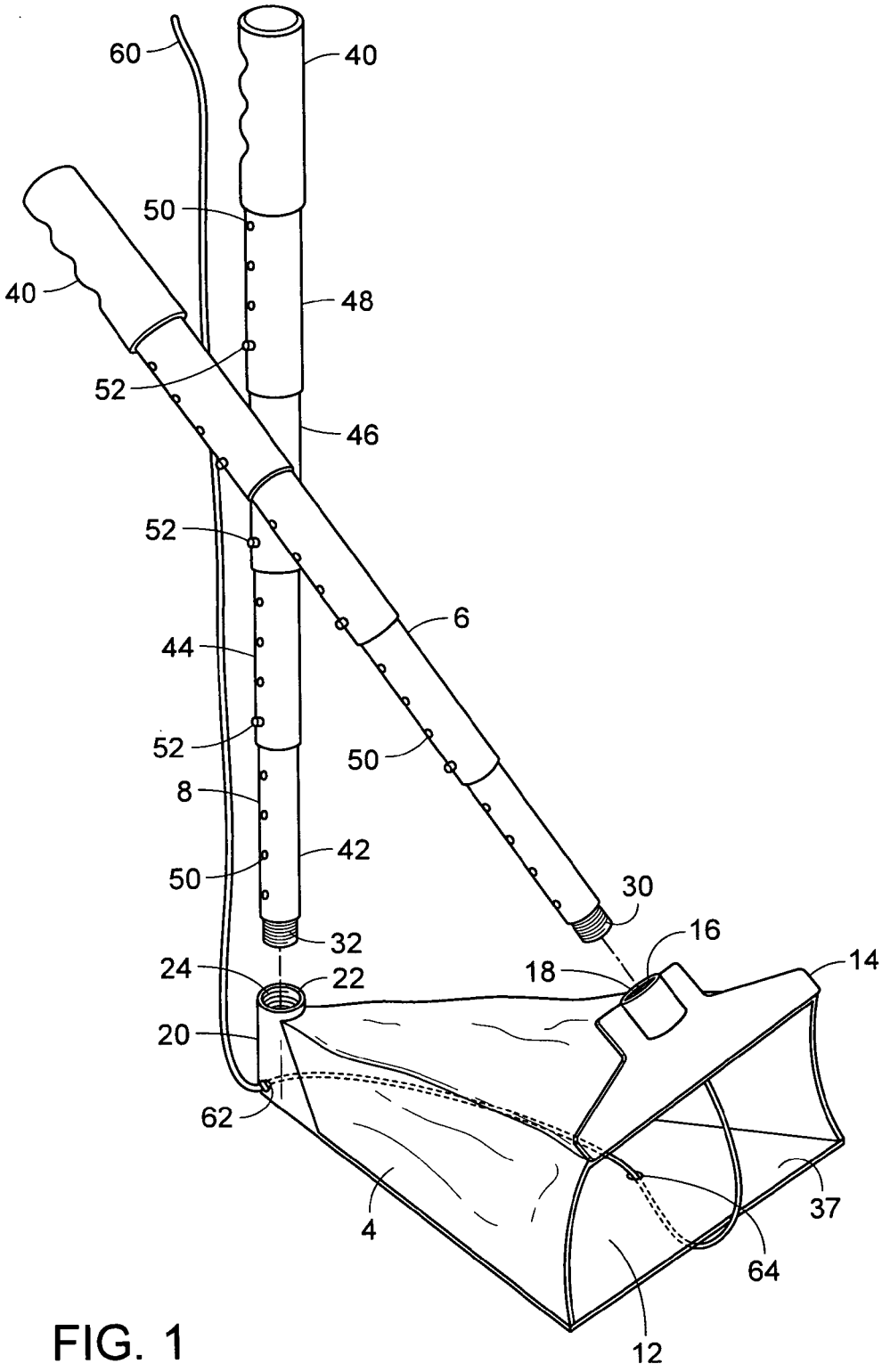
FIG. 1 shows a perspective view of the bag associated with the animal waste removal apparatus without the holding poles attached.
Figure 2:
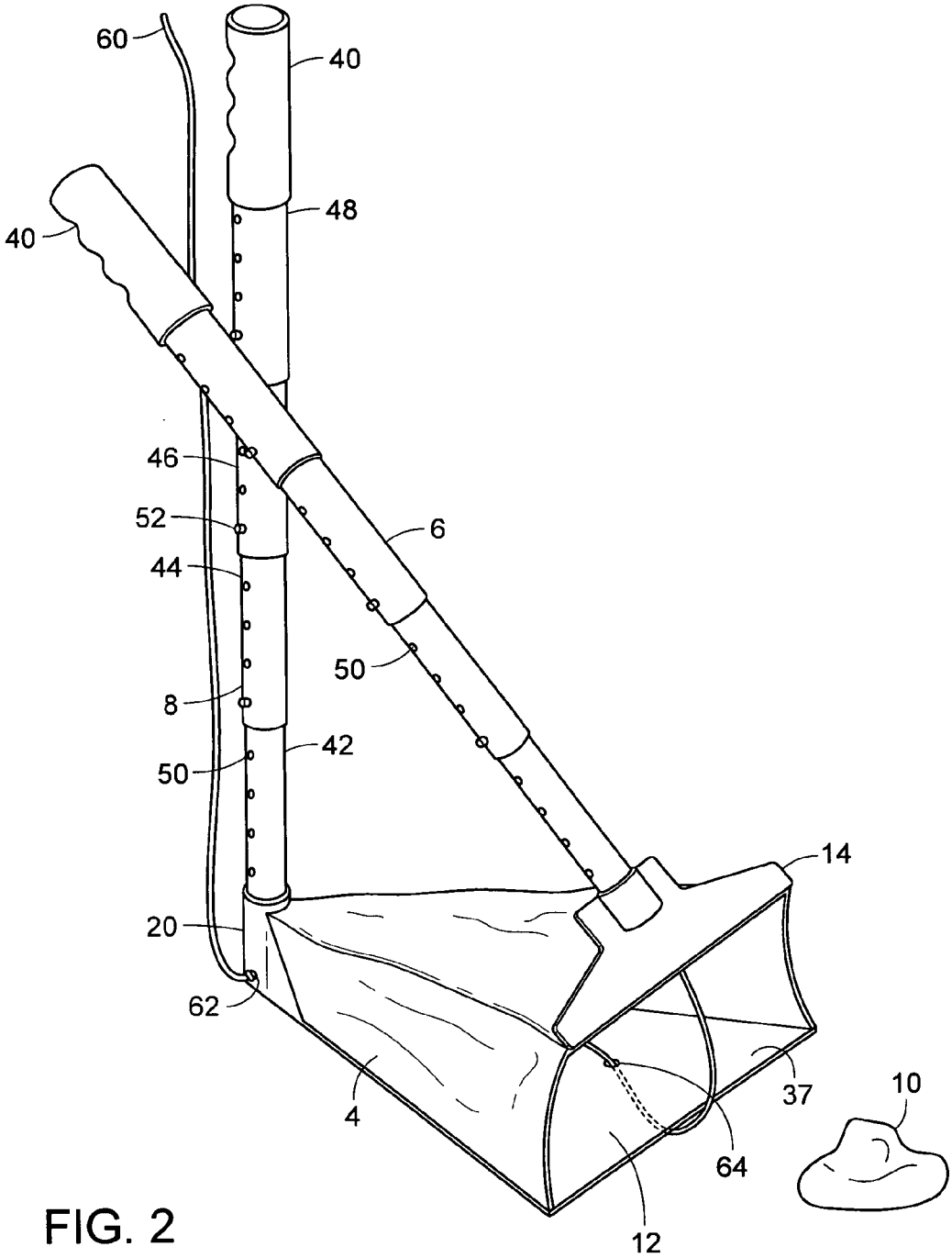
FIG. 2 shows a perspective view of the bag associated with the animal waste removal apparatus after the holding poles have been attached and as the animal waste removal apparatus is about to pick up some animal waste.

FIG. 1 shows a perspective view of the bag 4 associated with the animal waste removal apparatus 2 without the holding poles 6 and 8 attached, while FIG. 2 shows a perspective view of the bag 4 associated with the animal waste removal apparatus 2 after the holding poles 6 and 8 have been attached and as the animal waste removal apparatus 2 is about to pick up some animal waste 10.

Bag 4 itself is fabricated from a water-resistant substance in order to prevent the bag from absorbing moisture from the animal waste 10 or from other objects. The bag 4 is used only once and disposed. There is no need for washing and re-using the bag, as multiple bags 4 will be supplied with the present invention.

Bag 4 has two ends, an open and a closed end. The open end has an opening 12 and has a front plate 14 attached adjacent to the opening 12. The front plate 14 has a hole 16 with internal threads 18 in it and has two surfaces, an inner surface and an outer surface. The bag 2 also has a rear plate 20 that has a hole 22 with internal threads 24 in it. Rear plate 20 is attached to a base 37 which provides bottom structural support for the apparatus 2.

Holding poles 6 and 8 each have two ends, a first end and a second end. The first end of holding pole 6 has external threads 30 and can be threadably attached to the internal threads 18 within the hole 16 on the front plate 14. The first end of holding pole 8 has external threads 32 and can be threadably attached to the internal threads 24 within the hole 22 on the rear plate 16. The second end of each of the holding poles 6 and 8 have handles 40 for easy grasping while in use.

Each of the holding poles 6 and 8 are composed of four separate sections, including a first section 42, a second section 44, a third section 46, and a fourth section 48. The first section 42 of both holding poles 6 and 8 is the one attached to the actual bag 4. Second section 44 of each of the holding poles 6 and 8 is telescoping within each associated first section 42, third section 46 of each of the holding poles 6 and 8 is telescoping within each associated second section 44, and fourth section 48 of each of the holding poles 6 and 8 is telescoping within each associated third section 46. Each of the sections has a plurality of holes 50 which allow each of the holding poles to be adjusted to virtually any length in between one section length and four section lengths. Each of the holding poles 6 and 8 has a pin 52 which can be inserted through all of the sections in order to temporarily "set" a holding pole at a particular length.

Each of the sections 42-48 are preferably nine inches in length, giving each of the holding poles 6 and 8 a potential length of between nine inches and thirty-six inches. Due to spatial considerations, the actual range may be a bit smaller.

Apparatus 2 also has a drawstring 60 which has two ends, a first end and a second end. The first end of the drawstring 60 is inserted into a hole 62 on the rear plate 20 and travels toward the location of the opening 12 on the bag 4. The first end of the drawstring 60 then travels within the base 37 until it nears the opening, at which time, it passes through a hole 64 in the base 37 and travels underneath the base 37 and in front of the opening 12 to fixedly connect to the inner surface of the front plate 14. Through manipulating of the holding pole 6 and the drawstring 60, an individual can easily open the opening 12 (by pulling on the holding pole 6 and relaxing the grip on the drawstring 60) or close the opening 12 (by releasing or removing the holding pole 6 and pulling upward on the drawstring 60). Pulling upward on the drawstring 60 causes the front plate 14 to seal the opening 12, at which time, the apparatus 2 can be appropriately picked up and carried away like a tote bag.

Figure 3:
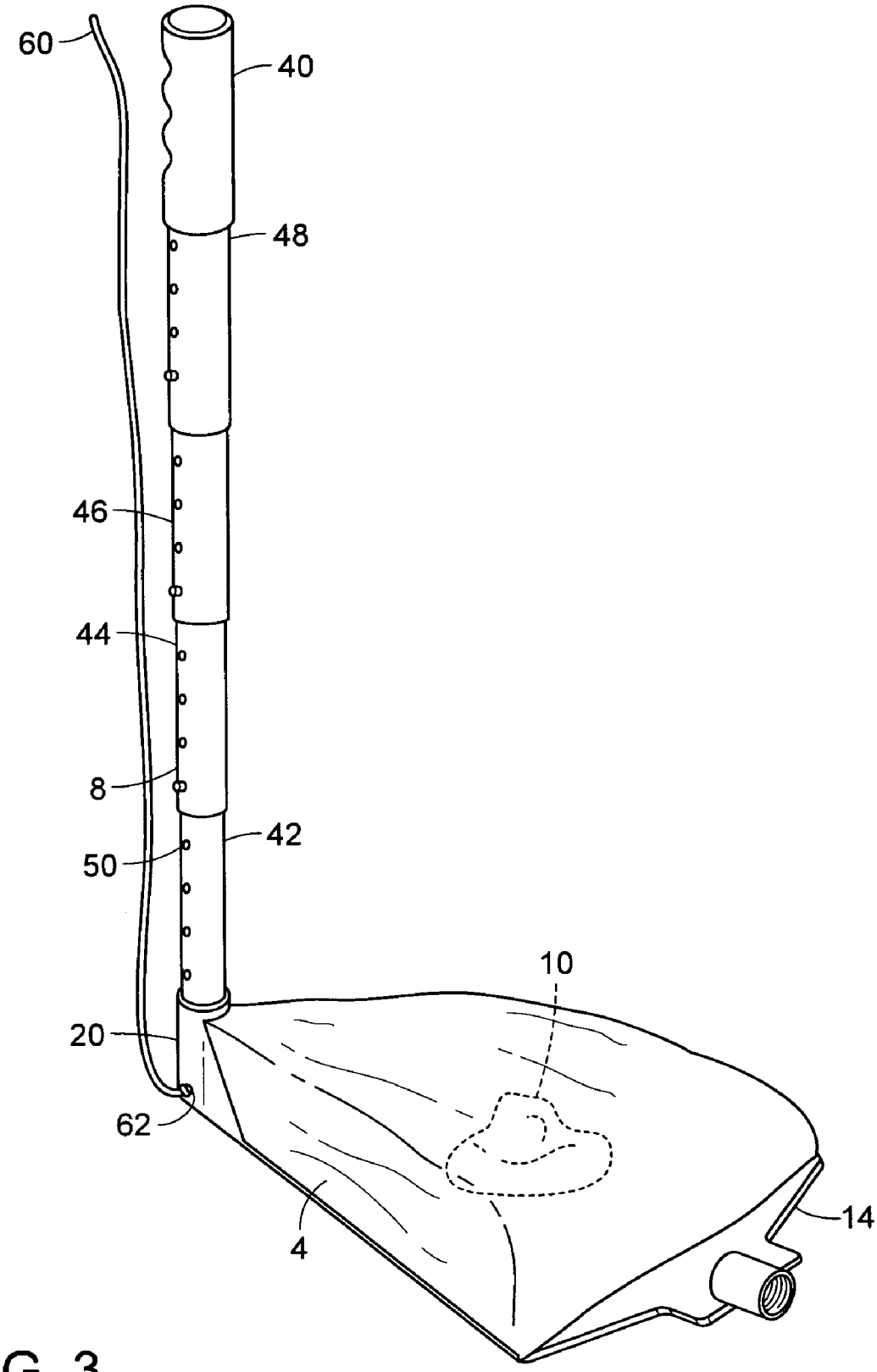
FIG. 3 shows a perspective view of the bag associated with the animal waste removal apparatus after the apparatus has picked up some animal waste and the front opening has been shut.

FIG. 3 shows a perspective view of the bag 4 associated with the animal waste removal apparatus 2 after the apparatus 2 has picked up some animal waste 10 and the front opening 12 has been shut. Through manipulating of the holding pole 6 and the drawstring 60, an individual can easily open the opening 12 (by pulling on the holding pole 6 and relaxing the grip on the drawstring 60) or close the opening 12 (by releasing or removing the holding pole 6 and pulling upward on the drawstring 60). Pulling upward on the drawstring 60 causes the front plate 14 to seal the opening 12, at which time, the apparatus 2 can be appropriately picked up and carried away like a tote bag.

Figure 4:
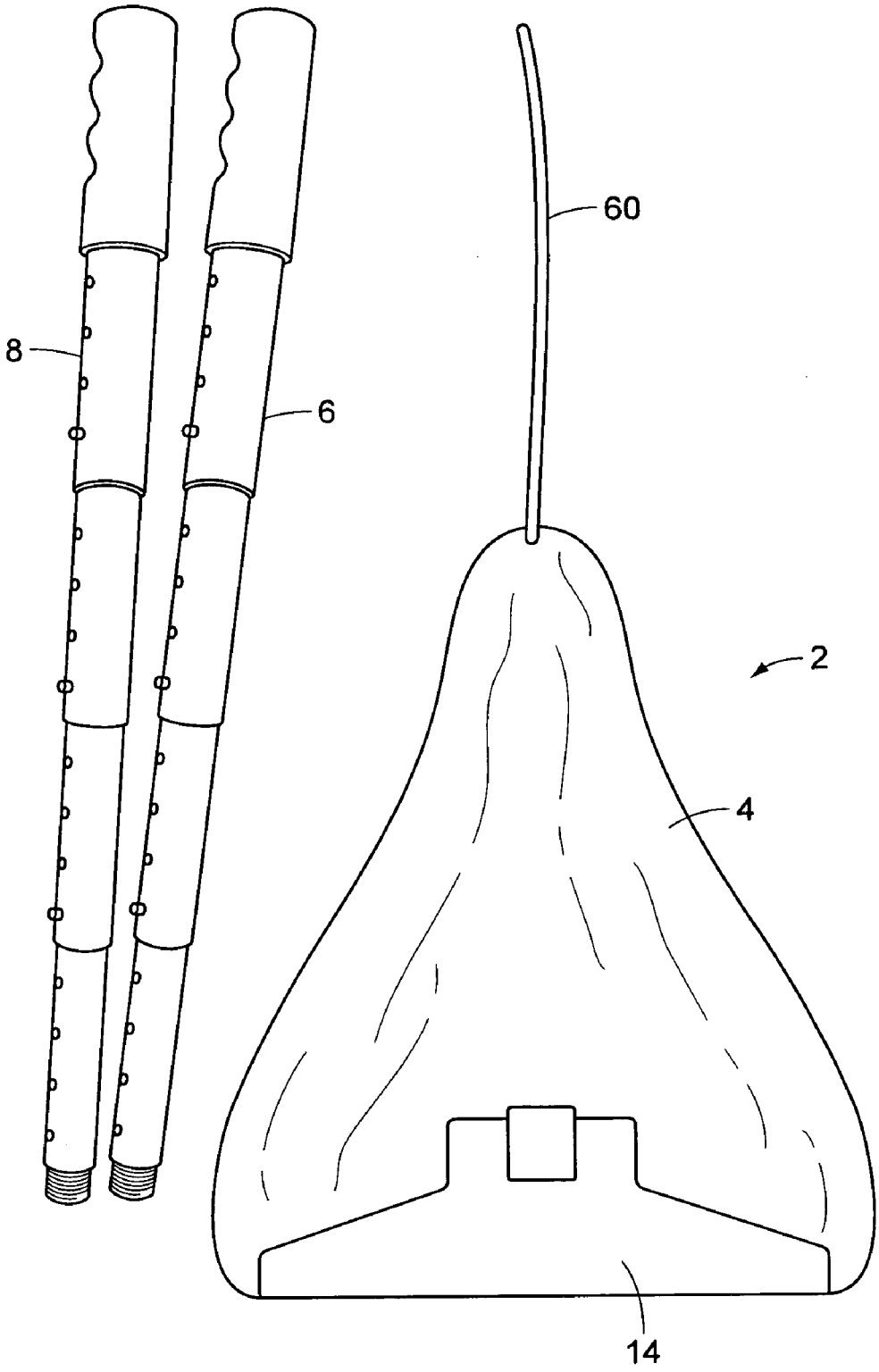
FIG. 4 shows a perspective view of the bag associated with the animal waste removal apparatus after the holding poles have been removed from the bag and the drawstring has been pulled upwards.

FIG. 4 shows a perspective view of the bag associated with the animal waste removal apparatus 2 after the holding poles 6 and 8 have been removed from the bag 4 and the drawstring 60 has been pulled upwards. In this position, the apparatus 2 can be appropriately picked up and carried away like a tote bag.

What I claim as my invention is:

1. An animal waste removal apparatus comprising:

(a) a bag having two ends, an open end and a closed end, (b) an opening at the open end of the bag (c) a front plate attached to the bag adjacent to the opening, (d) a first hole located in the front plate, the first hole having a plurality of internal threads in it, (e) a rear plate attached to the bag, (f) a second hole located in the rear plate, the second hole having a plurality of internal threads in it, (g) a pair of holding poles comprising a first holding pole and a second holding pole, each of the holding poles having two ends, a first end and a second end, (h) a pair of handle units comprising a first handle unit and a second handle unit, the first handle unit being attached to the second end of the first holding pole, the second handle unit being attached to the second end of the second holding pole, (i) a first plurality of external threads attached to the first end of the first holding pole, wherein the first plurality of external threads can be attached to the plurality of internal threads located in the first hole, (j) a second plurality of external threads attached to the first end of the second holding pole, wherein the second plurality of external threads can be attached to the plurality of internal threads located in the second hole, (k) a drawstring having two ends, a first end and a second end, the first end of a drawstring inserted through a third hole on the rear plate, further wherein the first end of the drawstring then passes underneath an base until it passes through a fourth hole in the base, further wherein the first end of the drawstring then is fixedly attached to the inner surface of the front plate, (l) wherein manipulation of the first holding pole and the drawstring, an individual can open or close the opening of the animal waste removal apparatus as needed, (m) wherein the bag is disposable once sufficient animal waste has been placed within the bag.

2. An animal waste removal apparatus according to claim 1 wherein each of the holding poles further comprises four separate sections, each of the sections being nine inches in length, each of the sections being successfully telescoping in adjacent sections, wherein the total length of the four sections of each holding pole may be between nine inches and thirty-six inches.

3. An animal waste removal apparatus according to claim 2 wherein each of the sections has a plurality of holes, further wherein each holding pole has a plurality of pins, each pin being used to join two or more sections of a particular holding pole into a set position.

4. An animal waste removal apparatus according to claim 3 wherein the bag is fabricated from a water-resistant substance.

* * * * *